United States Patent [19]

Jackson

[11] 4,021,887

[45] May 10, 1977

[54] COTTON GIN CONTROL

[76] Inventor: Samuel G. Jackson, P.O. Box 16587, Lubbock, Tex. 79490

[22] Filed: Sept. 29, 1975

[21] Appl. No.: 617,681

[52] U.S. Cl. ..... 19/66 R; 19/39
[51] Int. Cl.[2] ..... D01B 1/04
[58] Field of Search ..... 19/66 R, 64.5, .27, 19/66 CC, 39; 165/21

[56] References Cited

UNITED STATES PATENTS

| | | | |
|---|---|---|---|
| 3,320,640 | 5/1967 | Van Doorn | 19/64.5 |
| 3,451,105 | 6/1969 | Nayfa | 19/66 CC |
| 3,495,303 | 2/1970 | Slover | 19/64.5 |

*Primary Examiner*—Dorsey Newton
*Attorney, Agent, or Firm*—Wendell Coffee

[57] ABSTRACT

A controller converts the number of operating stands in a cotton gin plant into a simulated stepwise movement of a potentiometer for modulating control of a humidifier. i.e., processing units of a cotton gin plant are regulated according to the rate of cotton being ginned.

20 Claims, 2 Drawing Figures

COTTON GIN CONTROL

CROSS-REFERENCE TO RELATED APPLICATIONS

None. However, Disclosure Document No. 033605 was filed in the Patent Office on July 8, 1974, and a separate paper requesting transfer of that document to this application is filed herewith.

BACKGROUND OF THE INVENTION

1. Field of the Invention

This invention relates to controls for cotton gin equipment.

2. Description of the Prior Art

"Humidaire" is the trademark used for a cotton gin humidifier manufactured by Samuel Jackson Manufacturing Corporation, a corporation controlled by the applicant herein. The Humidaire unit comprises a direct-fired air heater, in which a gas-fired burner operates with an open flame in the stream of air to be humidified, followed by an air washer, in which a recirculated water spray scrubs the heated air, simultaneously cooling the air and evaporating water. The result is a supply of warm humid air of about 38° to 60° C and 80 percent relative humidity.

Customarily, the water pump is operated constantly during operation. To change the output of the humidifier in response to demand, the burner output is increased or decreased to increase or decrease respectively the amount of water evaporated and the amount of humidification achieved in the cotton to which the air is applied. The final control element in this case is a motorized gas valve.

Various automatic controls have been used for humidifiers. Some have sensed moisture content of the humidified cotton indirectly by measuring its resistivity, and others have measured air temperatures. These systems have been rather complex electronic devices.

In order to avoid the complexity of automatic controls, most cotton gin humidifiers are regulated by a remote manual control. The ginner simply turns a potentiometer to adjust the opening of the motorized gas valve.

SUMMARY OF THE INVENTION

1. New and Different Function

I have invented a control which produces a stepwise modulated output of a device such as a humidifier in response to the amount or rate of cotton ginned, as inferred from the number of gin stands in operation. This represents a compromise between a simple manual control and a complex, expensive automatic control regulated by product humidity. It utilizes the simplicity and dependability of a manual control, yet relieves the ginner of much responsibility.

This invention also provides an automatic means wherein a cotton gin humidifier will be made to operate in the humidify mode when any one of several gin stands are operating, but will operate as a heater at a preset level when no gin stand is in operation.

Examples of equipment in a cotton gin plant other than humidifiers applicable for control by my invention include regulating the sampling rate of an automatic sampler, regulating the stroke rate of a tramper at the press box, and controlling the speeds of condenser drums on the battery condenser and on lint cleaners.

2. Objects of this Invention.

An object of this invention is to control cotton gin equipment.

Other objects are to achieve the above with a device that is sturdy, compact, durable, lightweight, simple, safe, efficient, versatile, and reliable, yet inexpensive and easy to manufacture, install, adjust, operate, and maintain.

Further objects are to achieve the above with a method that is versatile, rapid, efficient, and inexpensive, and does not require skilled people to install, adjust, operate, and maintain.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Figure 1:
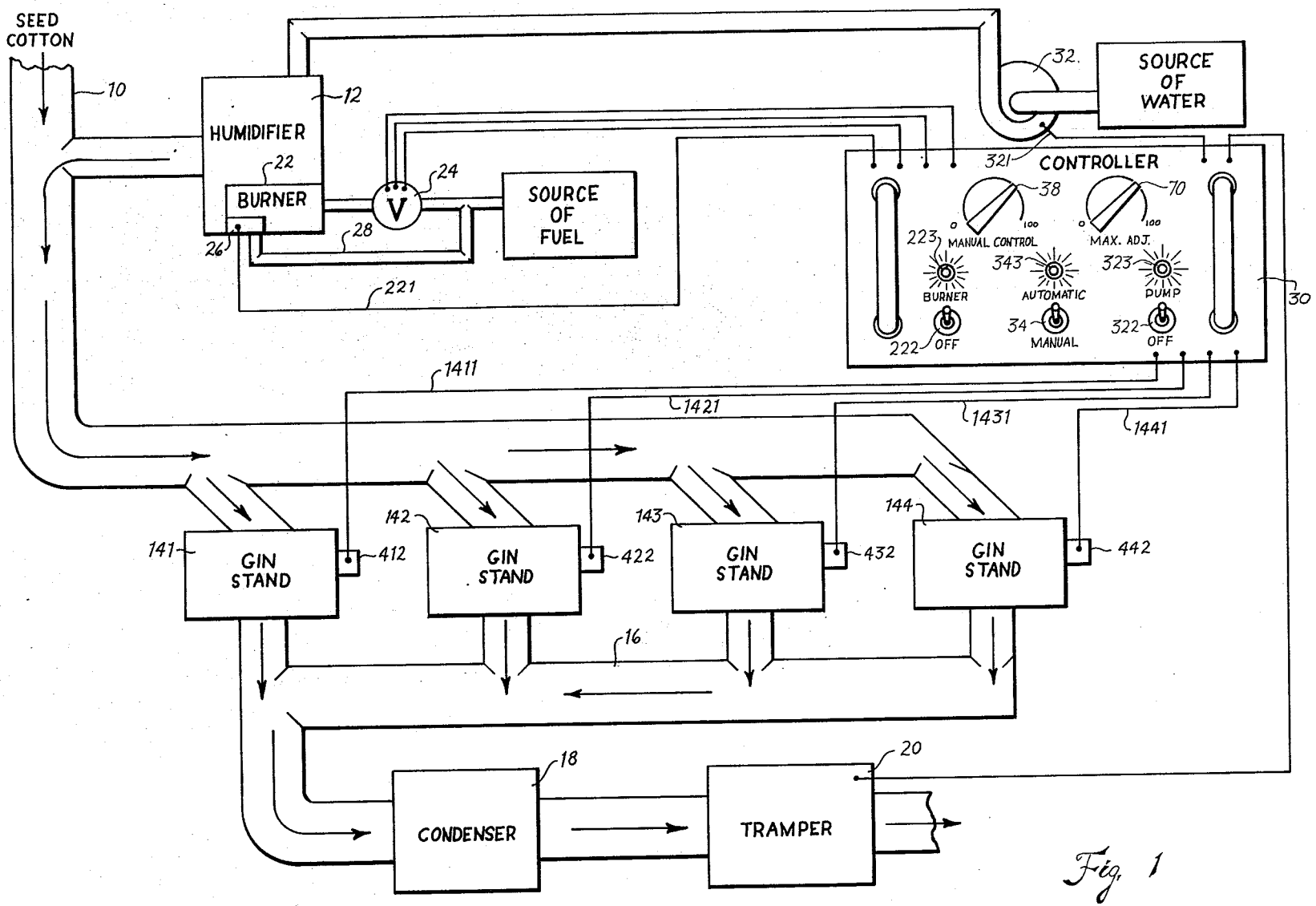
FIG. 1 is a schematic representation of parts of a cotton gin plant and the face of the control according to this invention.

An embodiment of my invention is shown in the drawing. Referring particularly to FIG. 1, there may be seen a schematic representation of parts of a cotton gin. In this representation, the seed cotton enters through conduit 10. The air is humidified by humidifier 12 and added to the conduit 10. Seed cotton proceeds through other cleaning steps (not shown for clarity) and is subsequently fed to a plurality of gin stands 141, 142, 143, and 144. Although this application illustrates four gin stands, as the description proceeds, it will be understood that the cotton gin plant could include any number of stands. From the gin stands, lint cotton proceeds through conduit 16 to condenser 18 where the lint is separated from the air and the lint is then tramped by tramper 20 into a press box. Those skilled will look upon this schematic representation and description as being only in the broadest terms, generally describing the equipment in a cotton gin plant.

The humidifier 12 will include a fan (not shown), a burner 22 supplied by main modulated fuel valve 24 and a starter 26 supplied by a separate pilot fuel tube 28 which bypasses the main fuel valve 24. The main fuel valve 24 supplies the burner 22 with fuel from a source of fuel. The amount of fuel supplied by the valve is controlled by controller 30. The particular type control valve used is a modulating gas valve. It has a 110 volt power source, but is controlled by a three-wire control. This three-wire control is designed to be connected across a 135-ohm potentiometer. The outside two contacts or wires extend to either end of the potentiometer and the middle contact or wire is connected to the wiper of the potentiometer.

Figure 2:
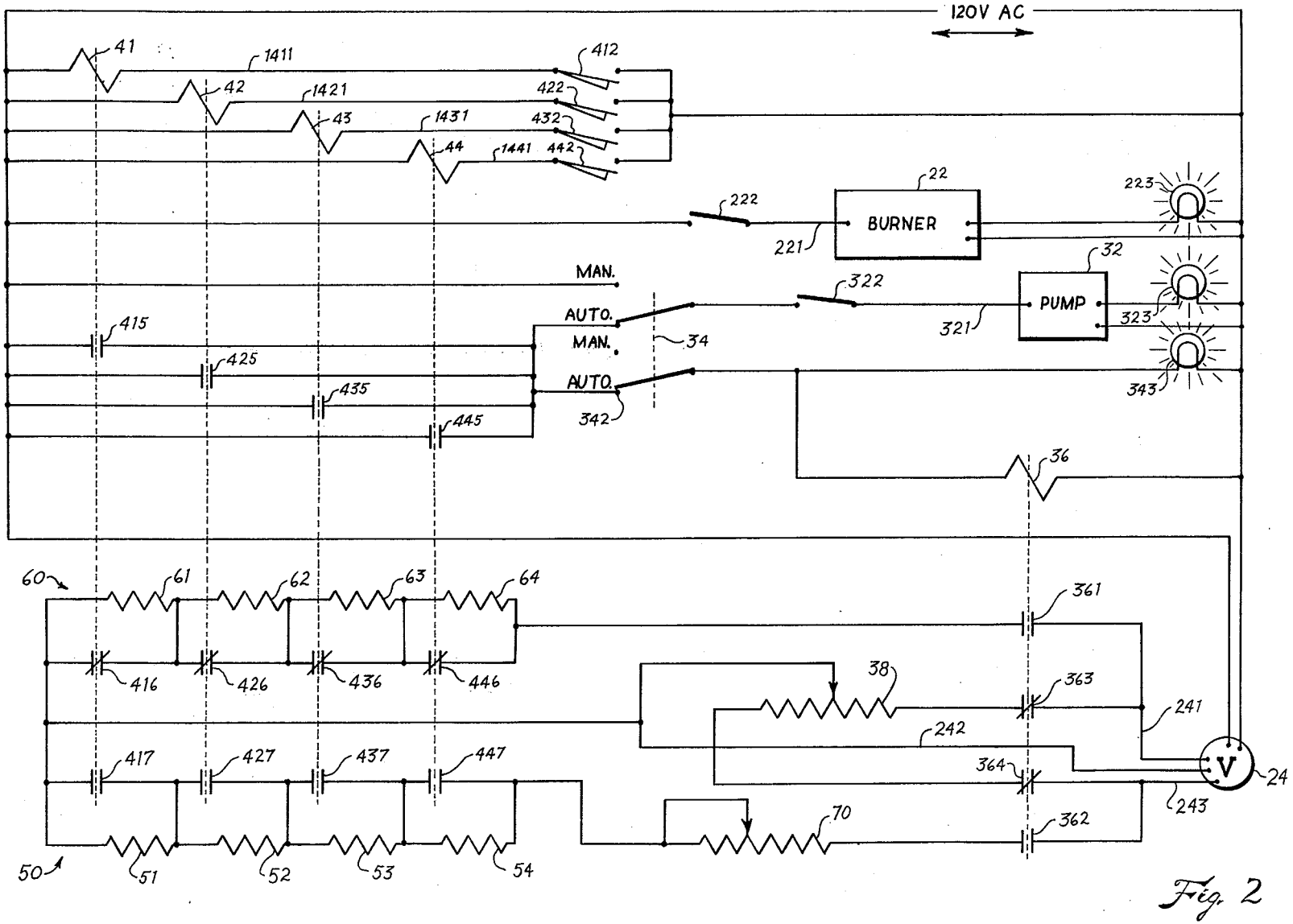
FIG. 2 is a schematic representation of the circuit of the control.

Referring particularly to FIG. 2, if the resistance between electrical connection 241 and electrical connection 242 is zero and the resistance between electrical connection 242 and 243 is 135 ohms, the valve 24 will be closed. If the resistance between electrical connections 241 and 242 is increased (and the resistance between contact 242 and 243 decreased), the valve will open at a point when the resistance between electrical connections 241 and 242 reaches 135 ohms value and the resistance between 242 and 243 reaches zero ohms in which case the valve 24 will be open to its fullest extent. Such valves are commonly commercially available on the market and this controller is described to particularly operate this valve.

The humidifier 12 is also furnished water from a source of water by pump 32. As previously mentioned, the valve 24 is controlled by the controller 30 through electrical connections 241, 242, and 243. Likewise, the burner 22 is controlled through line 221 and the pump 32 is controlled by the controller through line 321. Gin stand 141 furnishes information to the controller by line 1411, gin stand 142 supplies information by line 1421 and gin 143 supplies information by line 1431, etc.

The control panel 30 includes burner switch 222. When the burner switch is closed, the burner 22 is ignited and the burner indicator lamp 223 so indicates. The indicator lamp 223 is on the control panel, all as seen in FIG. 1. The connection of these controls and pilot lamps are shown in FIG. 2. If auto-manual switch 34 is in the manual position and pump switch 322 is in the closed position, the humidifier pump 32 will be activated. Indicator lamp 323 will indicate the pump is operating. With the auto-manual switch in the manual position, it may be seen that auto-relay coil 36 will not be energized. With the coil 36 not energized, the contacts 361 and 362 will be in their normal open position and contacts 363 and 364 will be closed. Therefore, the control of the valve 24 will be maintained solely by manual-adjust potentiometer 38. It will be noted that if the auto-manual switch 34 is in the manual position, the auto indicator lamp 343 will not be energized.

To summarize, it may be seen that when the auto-manual switch 34 is in the manual position, the operation and adjustment of the humidifier 12 will be entirely manual and controlled by the manual-adjust potentiometer 38.

Within the controller 30 there is a relay for and corresponding to each gin stand. I.e., relay coil 41 is for gin stand 141 and relay coil 42 is for gin stand 142, etc. Each of these relays are energized responsive to the gin stand being activated. Energization of each of these relay coils 41, 42, etc., has been schematically represented by switch 412 on gin stand 141 or switch 422 on gin stand 142 or switch 432 on gin stand 143. These switches could be limit switches for gin stands that are activated by mechanical engagement. However, it will be understood that more than likely in a more modern gin the relay coils 41, 42, 43, and 44 would each be energized according to whether the gin stands were electrically activated. This might be electrically on the feeder to the gin stand or an electrical control to the gin stand itself. However, those skilled in the art will understand how to pick up voltage from existing circuits and energize a relay coil responsive to whether the gin stand is activated or not and the showing of mechanical switches is only illustrative.

Each of the relays 41 through 44 has three contacts, two normally open and one normally closed. The normally open contacts 415, 425, 435, and 445 are connected parallel from a power source to the auto contact 342 of the auto-manual switch 34. The auto-manual switch is a double pole, double throw switch as specifically illustrated in FIG. 2. Therefore, it may be seen if the auto-manual switch 34 is in the automatic position and none of the gin stands 141, 142, etc., are activated, all of the contacts 415, 425, etc., will be open; therefore, the pump 32 will not be energized even if the pump switch 322 is closed. Thus, the pump, a Unit of Equipment in a coton gin, is deactivated responsive to an inferred ginning rate of zero. The pump light 323 will not be lit. Perhaps more important, the auto relay 36 will not be energized and, also, the auto indicator light 343 will not be energized. Therefore, even with the automatic switch 34 on automatic, if all of the gin stands are inactive, the heater valve is still controlled by the manual-adjust potentiometer 38. If it were operated in such position, the manual-adjust potentiometer 38 would be adjusted by the ginner to a certain minimum heat control for the heat the ginner desired to be placed upon the pipes in the stand-by position. Therefore, in this position, the manual-adjust potentiometer 38 would more properly be called a zero control, i.e., a control for zero rate of cotton processing.

If any one or any combination of gin stands are activated, then at least one of the contacts 415, 425, 435, and 445, will be closed. Therefore, the pump 32 will be energized if the pump switch 322 is closed and the pump light 323 will so indicate. Also, the auto indicator light 343 will indicate that the control is on automatic operation at this time and the automatic relay 36 will be energized opening contacts 363 and 364 and closing contacts 361 and 362. Thus, the control of the heater valve 24 is according to the automatic controls rather than the manual potentiometer 38. The fuel valve 24 and therefore the heat on the humidifier 12 will be controlled by what is a simulated potentiometer. This simulated potentiometer includes two of the contacts from the relays 41, 42, etc., each of which is in parallel with a resistor.

The resistors are shown as a first series of resistors 50 and a second series of resistors 60. The sum of the resistance of each series is equal to the resistance of the manual-adjust potentiometer 38 which in this case is 135 ohms. Also, the resistance of each resistor 51, 52, 53, and 54 of the series 50, will be proportional to the ginning rate of its corresponding gin stand 141, 142, 143, and 144. Likewise, each resistance in the second series 60, will be proportional to the ginning rate of its corresponding gin stand. If each of the gin stands have the same rated capacity, each of the resistances will be equal. Therefore, since it has been illustrated with a four-stand gin, each of the resistances would have one-fourth the resistance of the manual potentiometer 38, which is to say each would have a value of about 33 ohms.

Thus, an analysis of the simulated potentiometer (FIG. 2) will show that with the relay 36 energized, the lead 242 will be the center tap of the simulated potentiometer even as lead 242 was the center tap or wiper of the manual potentiometer 38. The resistance between the leads 241, 242 and 243 will depend upon how many of the gin stands are activated. I.e., if half of the gin stands are activated, half the normally closed contacts 416, 426, 436, and 446, will be open and, therefore, the resistance from lead 241 to 242 will be one-half. Also, half the contacts 417, 427, 437, and 447, will be closed, and the resistance from lead 242 to 243 will be equal the resistance from lead 241 to 242, (provided maximum adjust resistor 70 is set at zero). As another example, if one gin stand is activated which is one-fourth the total stands, the resistance between lead 241 and 242 will be 33 ohms and the resistance from the lead 242 and 243 will be 99 ohms. This, of course, assumes again that adjustable resistor 70 is at zero.

The operation is that of shorting each resistor of the first series by a first means in the form of a relay contact responsive to the activation of its corresponding gin stand, and shorting each resistor of the second series by a second means in the form of a relay contact responsive to the non-activation of its corresponding stand.

Thus, by the use of gin stand switches 412, 422, etc., the cotton gin stands which are activated is determined. The rate or quantity of the cotton being ginned or processed is inferred from those activated. This information by means of the simulated potentiometer controls or regulates or modulates the processing equipment according to the inferred rate which cotton is being ginned. Specifically, the pump is turned on and off according to the rate. The fuel valve 24 is regulated according to the rate. Also, as schematically indicated, the rate of the tramper 20 is regulated. Although only a single line is shown from the controller to the tramper, it will be understood that this regulation could be by a three wire control. Because only the two specific examples of the humidifier control and the tramper control are given, this is not meant to limit in any way the additional controls which could be utilized.

As an aid to correlating the terms of the claims to the exemplary drawing, the following catalog of elements is provided:

10 conduit
12 humidifiers
14 gin stand
  141 stand 1411 wire
  142 stand 1421 wire
  143 stand 1431 wire
  144 stand 1441 wire
16 conduit
18 condenser
20 tramper
22 burner
  221 wire
  222 switch
  223 light
24 valve
  241 wire
  242 wire
  243 wire
26 burner starter
28 tube
30 controller
32 pump
  321 wire
  322 switch
  323 light
34 auto-manual switch
  342 contact
  343 light
36 auto relay
  361 contact open
  362 contact open
  363 contact closed
  364 contact closed
38 manual adjust potentiometer
41 relay
  412 switch
  415 contact open
  416 contact closed
  417 contact open
42 relay
  422 switch
  425 contact open
  426 contact closed
  427 contact open
43 relay
  432 switch
  435 contact open
  436 contact closed
  437 contact open
44 relay
  442 switch
  445 contact open
  446 contact closed
  447 contact open
50 first series resistor
  51 resistor stand 141
  52 resistor stand 142
  53 resistor stand 143
  54 resistor stand 144
60 second series resistor
  61 resistor stand 141
  62 resistor stand 142
  63 resistor stand 143
  64 resistor stand 144
70 maximum adjust resistor The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. The method of controlling equipment in a cotton gin plant comprising the steps of:
  a. determining which of a plurality of cotton gin stands in the cotton gin plant are activated by equipment including
    i. a first series of resistors, each resistor of which corresponds to a gin stand,
    ii. a second series of resistors, each resistor of which corresponds to a gin stand, and
    iii. a center tap and the process including
    iv. connecting the first series of resistors to the center tap and
    v. connecting the second series of resistors to the center tap and
    vi. shorting resistors in the first series responsive to the corresponding gin stand being in a not activated condition,
  b. inferring the rate of cotton being ginned from the stands which are activated as determined above, and
  c. regulating units of said equipment according to and responsive to the rate of cotton being ginned as inferred above.

2. The invention as defined in claim 1 wherein the equipment includes a humidifier with a fuel valve and the regulation is
  d. regulating the fuel valve of the humidifier responsive to the inferred rate.

3. The invention as defined in claim 1 with an additional limitation of deactivating some units of equipment responsive to an inferred rate of zero.

4. The invention as defined in claim 3 wherein the equipment includes a humidifier with a fuel valve and the regulation is d. regulating the fuel valve of the humidifier responsive to the inferred rate.

5. A control for equipment in a cotton gin plant having a plurality of gin stands, comprising:

a. a first series of resistors, each resistor of which corresponds to one of the gin stands, b. a second series of resistors, each resistor of which corresponds to one of the gin stands, c. a center tap connected to each series of resistors at one end thereof, d. first means connected to each resistor in the first series for shorting that resistor responsive to the activation of its corresponding gin stand, and e. second means connected to each resistor in the second series for shorting that resistor responsive to the non-activation of its corresponding gin stand.

6. The invention as defined in claim 5 wherein f. said first means includes a normally open contact of a relay for a corresponding gin stand and g. said second means includes a normally closed contact of the relay for the corresponding gin stand.

7. The invention as defined in claim 6 with an additional limitation of energizing means interconnected to the gin stand and relay for energizing the relay responsive to activation of the gin stand.

8. The invention as defined in claim 5 wherein f. said equipment includes a fuel-fired humidifier, g. a fuel valve on said humidifier and h. electrical connections from said valve to said center tap and said first and second series.

9. The invention as defined in claim 8 wherein j. said first means includes a normally open contact of a relay for a corresponding gin stand and k. said second means includes a normally closed contact of the relay for the corresponding gin stand.

10. The invention as defined in claim 9 with an additional limitation of energizing means interconnected to the gin stand and relay for energizing the relay responsive to activation of the gin stand.

11. In a cotton gin plant having a. a plurality of stands and b. other operatively associated equipment, c. an improved control circuit for some of the other equipment in the gin plant in combination comprising:

cc. two resistors for each gin stand, d. electromechanical relays, each energized by the activation of one of the stands, and e. each relay, when activated, i. shorts one of said resistors which is normally unshorted, and ii. ceases shorting the other of said resistors, which is normally shorted, f. the two resistors each having a value of resistance proportional to the ginning rate of the stand which activated the relay, and g. the normally shorted resistors connected in series, forming a series circuit, h. the normally unshorted resistors connect in series, forming a series circuit, j. one end of each of the series circuits joined, k. the junction and opposite ends of the two series circuits comprise the terminals of a simulated potentiometer which is connected to the other equipment and is means for regulating it m. in response to the total ginning rate of the stands activated.

12. The invention as defined in claim 11 with additional limitations of n. a variable resistor electrically connected in series with o. one of the series circuits.

13. The invention as defined in claim 11 in which an additional normally open contact of each relay is connected in parallel to stop a separate unit when none of the stands is activated.

14. The invention as defined in claim 11 in which the other equipment is a humidifier.

15. The invention as defined in claim 14 with an additional limitation of n. a fuel valve on the humidifier, said fuel valve connected to the simulated potentiometer.

16. The invention as defined in claim 15 in which an additional normally open contact of each relay is connected in parallel to transfer control of the humidifier fuel valve to a different controller when no gin stand is activated.

17. The invention as defined in claim 14 in which an additional normally open contact of each relay is connected in parallel to stop a water pump on the humidifier when none of the stands is activated.

18. The invention as defined in claim 17 with an additional limitation of n. a fuel valve on the humidifier, said fuel valve connected to the simulated potentiometer.

19. The invention as defined in claim 18 with additional limitations of o. a variable resistor electrically connected in series with p. one of the series circuits.

20. The invention as defined in claim 19 in which said additional normally open contact of each relay also is means for transferring control of the humidifier fuel valve to a different controller when no gin stand is activated.

* * * * *